United States Patent [19]

Berndt, Jr.

[11] Patent Number: 4,903,444

[45] Date of Patent: Feb. 27, 1990

[54] FLOOR GRATING

[76] Inventor: Fred P. Berndt, Jr., c/o Arden Architectural Specialties, Inc., 181 Ely St., NE., Minneapolis, Minn. 55432

[21] Appl. No.: 252,699

[22] Filed: Oct. 3, 1988

[51] Int. Cl.[4] ..... B44D 5/08

[52] U.S. Cl. ..... 52/177; 52/667; 52/668

[58] Field of Search ..... 52/666, 667, 668, 177, 52/180, 181; 119/28

[56] References Cited

U.S. PATENT DOCUMENTS

| | | | |
|---|---|---|---|
| 3,383,822 | 12/1965 | Viehmann et al. . | |
| 3,469,359 | 9/1969 | Nagin | 52/177 |
| 4,112,640 | 9/1978 | Reifsnyder | 52/177 |
| 4,727,704 | 3/1988 | Carlton | 52/667 |

OTHER PUBLICATIONS

4 Page Excerpt—J.L. Industries.

4 Page Excerpt—Reese Enterprises, Inc.

*Primary Examiner*—David A. Scherbel

*Assistant Examiner*—Creighton Smith

*Attorney, Agent, or Firm*—Schweitzer & Cornman

[57] ABSTRACT

A floor grating assembly is disclosed, which comprises tread rails arranged in closely spaced parallel relation and held by spacer bars. The spacer bars, which are notched, are inserted in alignment openings of preferably triangular shape in the tread rails. After insertion, the spacer bars are rotationally reoriented to a position securing the tread rails in spaced apart relation. Flange means extending along the lower edges of the spacer bars are locally deformable into locking notches formed in the alignment openings. The spacer bars are thus locked against rotation out of their operative positions. Manufacturing economies and structural improvements are realized.

5 Claims, 2 Drawing Sheets

FLOOR GRATING

BACKGROUND AND SUMMARY OF THE INVENTION

The invention relates to the field of floor gratings, particularly of the type comprising a series of rigid tread rails, typically formed of extruded aluminum, arranged in a side-by-side series, with a narrow spacing between adjacent rails. The tread rails are rigidly secured in the described configuration and typically are installed in a suitable recess provided in the floor surface. The arrangement is such that the upper surfaces of the tread rails form, in effect, a continuation of the surrounding floor surface.

Floor grating structures of the general type described are well known in the art. The viehmann, et al. U.S. Pat. No. 3,383,822 and the Reifsnyder U.S. Pat. No. 4,112,640 are representative of known constructions of these devices.

In the construction of floor gratings, consideration is given to the manner in which the tread rails are secured together and held in predetermined spaced relation. The desired objective is to accomplish the desired spacing and securement in a manner that accommodates economical manufacture and assembly of the grill structures. The Viehmann, et al. and Reifsnyder disclosures illustrate useful techniques for this purpose wherein the tread rails are provided with aligned openings for the reception of a plurality of spacing bars arranged to extend transversely from one side of the assembly to the other. The tread rail openings accommodate insertion of the spacing bars in a predetermined rotational orientation. After the initial insertion, the spacing bars are rotated into a locking position, in which the tread rails are affixed in the desired spaced relation. The arrangement is also such that final positioning of the spacing bar serves to lock the assembly in a desired rectangular orientation, preventing skewing of the assembly into a parallelogram configuration. Various techniques are then employed to secure the spacing bars in their final positions. Some manufacturers utlize tack welds, others provide arrangements for deforming one or both of the assembled members in some way that prevents rotation of the spacing bar out of its assembled position.

The present invention is directed to improvements in the construction of otherwise known floor grating structures, especially of the general type disclosed in the Reifsnyder U.S. Pat. No. 4,112,640. In particular, the structure of the present invention incorporates an improved and simplified spacing bar arrangement which provides for structural improvement in the spacing bar and more importantly, provides for a simplified and highly effective facility for securing the spacing bar in its final, assembled position, avoiding the need for tack welds or complex mechanical operations.

For a more complete understanding of the above and other features and advantages of the invention, reference should be made to the following detailed description of a preferred embodiment of the invention and to the accompanying drawings.

DESCRIPTION OF A PREFERRED EMBODIMENT

Figure 1:
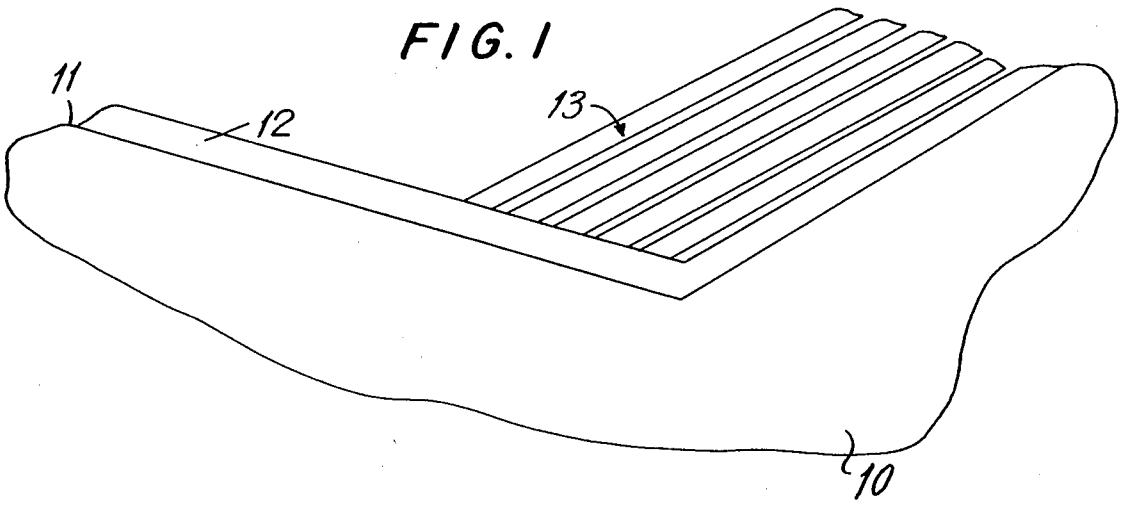
FIG. 1 is a fragmentary perspective view of a floor grating installation of the type contemplated by the present invention.

Referring now to the drawings, the reference numeral 10 (FIG. 1) represents a floor surface provided with a recess 11. Within the recess, there is typically provided a frame 12, which forms a catch basin and provides support surfaces (not shown) for supporting a floor grating structure 13 flush with the floor surface. The grating structure includes a plurality of tread rails 14, typically formed of extruded aluminum, which are arranged sideby-side, in parallel relation with a small spacing 15 provided betwen adjacent rails. The rails 14 include a base portion 16, a vertical web 17, and a tread support 18. The tread support includes opposed retaining flanges 19, 20 which engage and retain the backing 21 of a carpet strip 22 or the like, forming the upper tread surface. If desired, resilient pads 23 may be applied over the base flanges 16 to provide resilient support for the tread rails.

Figure 5:
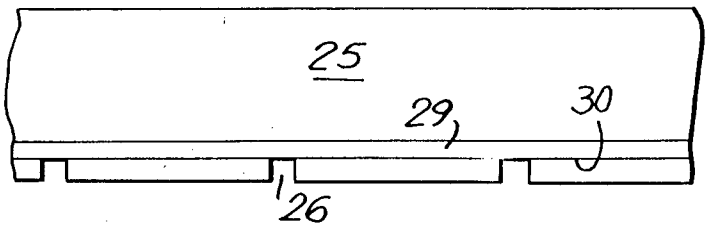
FIG. 5 is a fragmentary, elevational view of spacing bar according to the invention.

In accordance with generally known prinicples, e.g., Reifsnyder U.S. Pat. No. 4,112,640, the tread rails 14 are provided at two or more locations, spaced longitudinally along the rail, with openings 24 for the reception of spacer bars 25. Although the precise configuration of the openings 24 is quite variable, it is convenient to form them in a generally triangular configuration, with one vertical side 26 limited at the top and bottom by surfaces 27, 28. The vertical spacing between the upper and lower limiting surfaces 27, 28 is less by a predetermined amount than the height of the spacing bar 25, and the latter is provided with downwardly opening notches **26*a* (see FIG. 5) equal in width to the thickness of the webs 17, so as to closely embrace the opposite sides of the web portions 17** of the respective tread rails in the assembled structure.

To particular advantage, the spacer bars 25 are provided along one side with a longitudinally extending flange 29 projecting a short distance (e.g., one-eighth inch) out from the side face of the spacing bar. Desirably, the lower surface 30 of the projecting flange 29 substantially coincides with and thus defines the upper limit of the notches **26*a* as reflected in FIG. 5**.

Figure 2:
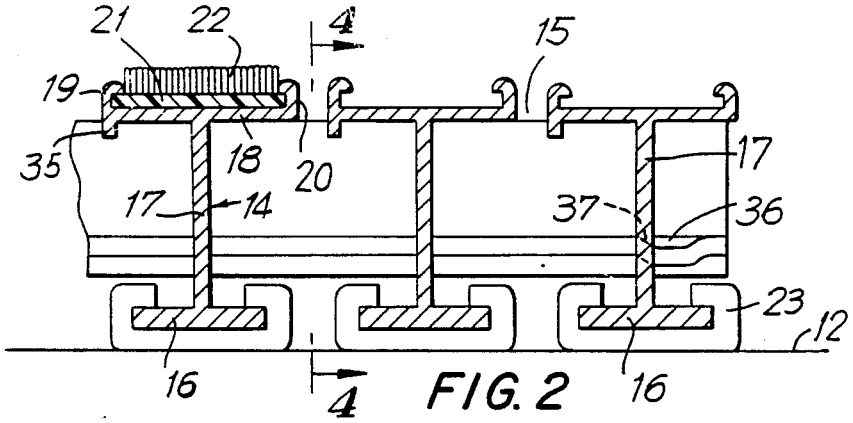
FIG. 2 is an enlarged, fragmentary cross sectional view, as taken generally on Line 2—2 of FIG. 1.
Figure 3:
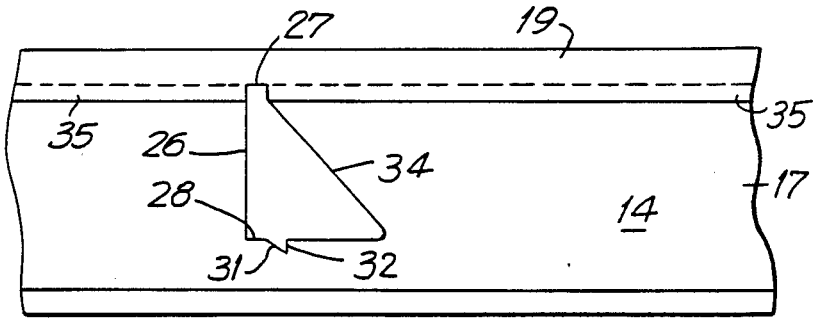
FIG. 3 is a fragmentary, side elevational view of tread rail of the structure of FIG. 1, showing details of the opening therein for receiving a spacing bar.
Figure 4:
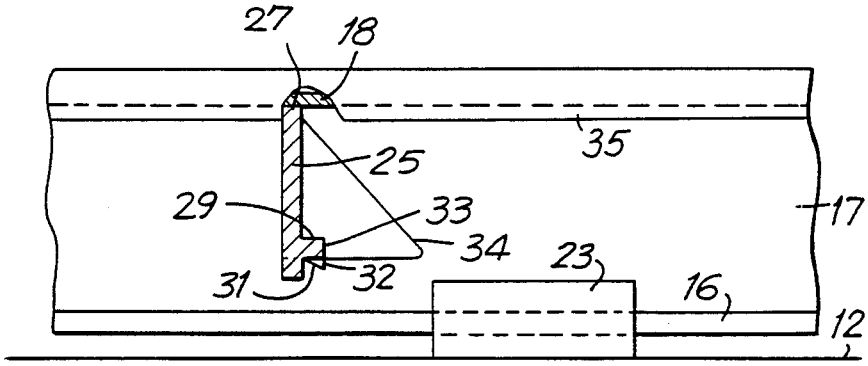
FIG. 4 is a fragmentary, cross-sectional view as taken generally on Line 4—4 of FIG. 2, illustrating the grating structure with a spacing bar installed therein.

In accordance with one aspect of the invention, the generally triangular opening 24 in the tread rail web is provided, immediately adjacent the lower support surface 28, with a locking notch or recess 31 defining an abutment surface 32. As shown in FIG. 4, the abutment surface 32 is located at or beyond th outer face 33 of the bar flange 29. This allows the flange 29 to be deformed downwardly at one or mor places, adjacent one or more tread rail webs 17, so that a portion of the bar flange 29 directly opposes the abutment surface portion 32 of the tread rail (see FIG. 2, righthand side).

In an assembly of a floor grating structure according to the invention, the tread rails 14 are arranged in the desired, spaced apart relation, typically by means of an appropriate assembly jig. Two or more spacing bars 25 then are inserted into the aligned sets of openings 24. To this end, the elongated sides 34 of the illustrated triangular openings provide sufficient clearance for insertion of the spacing bars 25, when in a first rotational orientation oriented at a slight angle to the vertical surfaces 26. When a spacer bar is properly inserted in position, it is rotated into a second (vertical) rotational orientation shown in FIG. 4, allowing the bar notches 26*a* to straddle the sides of the webs 17. In accordance with known principles, at least one side of each of the tread support flanges 18 is provided with a depending flange 35 (see FIG. 2) which is notched out to receive an uppr edge portion of a spacer bar 25. This assures that the tread rails and spacer bars will be retained in a desired, right angular relationship.

After preliminary assembly of the tread rails and spacer bars, each of the spacer bars is deformed at one or more locations by bending downwardly a portion 36 (FIG. 2) of the bar flange 29, so that at least a portion 37 of th bar flange is displaced downwardly into the lacking notch 31 and into abutting relationship with the abutment surface 32. According to the invention, this operation may be conveniently performed with a simple tool, such as a "Vice Grip" or similar device applied between the base flange 16 and the bar flange 29. When the bar flange 29 is thus displaced into the notch 31, the spacing bar cannot be rotated out of its assembled position, and the device is thus permanently assembled.

Theoretically, deformation of single area 37 into its related lacking notch 31 would be adequate for each of the spacing bars 25. However, the bar flanges 29 are easily accessible at each end of the structure for deformation, and it may be advantageous to deform the bar flange at a plurality of locations, at least at the opposite ends.

The structure of the invention provides for significant manufacturing economies as compared to the prior art structures, in that it enables the spacer bar to be permanently locked in its assembled position by a simple mechanical operation which is performed easily and quickly. Moreover, the provision of the bar flange 29 has the additional advantage of rigidifying the spacer bars 29.

It should be understood, of course, that the specific form of the invention herein illustrated and described is intended to be representative only as certain changes may be made therein without departing from the clear teachings of the disclosures. Accordingly, reference should be made to the following appended claims in determining the full scope of the invention.

I claim:

1. A floor grating assembly of the type comprising (a) a plurality of tread rails arranged in closely spaced parallel relation, (b) said tread rails each having a generally vertical web portion provided with alignment openings aligned with similar openings in adjacent tread rails, (c) a plurality of spacer bars received in said alignment openings, (d) said spacer bars having spacing notches formed therein for engagement with said tread rails, (e) said alignment openings being configured to enable lengthwise insertion of spacer bars in one rotational orientation thereof and to cause said rails to be engaged and spaced by said spacer bars in a second rotational orientation thereof, and (f) said alignment openings having side portions engaging one side of said spacer bars in said second rotational orientation, characterized by (g) said spacer bars being provided on the side thereof opposite said one side with longitudinally extending flange means projecting laterally therefrom, (h) at least certain of said alignment openings having locking notches formed therein located closely adjacent to, and adatped for the reception of, said flange means, and (i) said flange means being locally deformed in the region of aid locking notches after rotation of said spacer bars to said second rotational orientation, whereby portions of said flange means are displaced into said notches to prevent subsequent rotation of said spacer bars out of said second rotational orientation.

2. A floor grating assembly according to claim 1, further characterized by (a) said alignment openings being narrow at one edge side, for close confinement of one edge margin of a spacer bar, and wider at the opposite edge side to accommodate rotational reorientation of said spacer bars, and (b) said locking notches being located along said opposite edge side.

3. A floor grating assembly according to claim 2, further characterized by (a) said alignment openings being narrow at their upper edges side and wider at their lower edges sides, (b) said flange means being located adjacent to but spaced above the lower edges of said spacer bars, and (c) said notches being formed in the lower edges of said spacer bars, directly below said flange means.

4. A floor grating assembly to claim 1, further characterized by (a) said flange means, for each spacer bar, being deformed into locking notches of tread rails at opposite sides of the floor grating assembly.

5. A floor grating assembly according to claim 3, further characterized by (a) said tread rails having base flanges at the lower extremities of said webs, and (b) said flange means being deformable into said notches by the application of a squeezing tool between the base flange of a tread rail and the laterally projecting flange means of a spacer bar extending therethrough.

* * * * *